United States Patent [19]

Deroche et al.

[11] Patent Number: 4,597,283

[45] Date of Patent: Jul. 1, 1986

[54] METHOD FOR STRAIGHTENING A RAIL AND STRAIGHTENED RAIL

[75] Inventors: Raymond-Yves Deroche, Thionville; Yves Bourdon, Heining les Bouzonville; André Faessel, Saint Nicolas en Forêt, all of France

[73] Assignee: Societe Anonyme Dite: SACILOR, France

[21] Appl. No.: 392,216

[22] Filed: Jun. 25, 1982

[30] Foreign Application Priority Data

Feb. 19, 1982 [FR] France ..... 82 02817

[51] Int. Cl.[4] ..... B21D 1/05; B21D 3/12

[52] U.S. Cl. ..... 72/378; 72/206

[58] Field of Search ..... 72/256, 257, 302, 378, 72/206; 238/122, 125, 150

[56] References Cited

U.S. PATENT DOCUMENTS

| | | | |
|---|---|---|---|
| 1,966,955 | 7/1934 | Crampton | 72/392 |
| 2,167,485 | 7/1939 | Leisner et al. | 238/125 |
| 2,918,961 | 12/1959 | Seeley | 72/302 |
| 3,031,750 | 5/1962 | Von Planck | 72/378 |
| 3,193,270 | 7/1965 | Dewez, Jr. et al. | 238/122 |
| 3,257,832 | 6/1966 | Harvey | 72/378 |
| 3,826,124 | 7/1974 | Baksay | 72/378 |
| 4,156,360 | 5/1979 | Jacson et al. | 72/378 |
| 4,389,015 | 6/1983 | Guntermann et al. | 238/150 |

FOREIGN PATENT DOCUMENTS

| | | | |
|---|---|---|---|
| 573675 | 8/1923 | France . | |
| 962835 | 12/1947 | France . | |
| 2029100 | 1/1970 | France . | |
| 2132757 | 4/1972 | France . | |
| 2157792 | 6/1973 | France . | |
| 675970 | 7/1952 | United Kingdom | 72/378 |
| 749841 | 6/1956 | United Kingdom | 72/378 |

*Primary Examiner*—Lowell A. Larson

*Attorney, Agent, or Firm*—Bacon & Thomas

[57] ABSTRACT

The steel rail is submitted to a tensile stress exceeding the conventional 0.2% offset yield strength of the steel, up to a stress value corresponding to a total plastic deformation of the whole rail.

6 Claims, 14 Drawing Figures

METHOD FOR STRAIGHTENING A RAIL AND STRAIGHTENED RAIL

The invention relates to the finishing of rails and more particularly to the relaxation of stresses and the straightening of heat treated, standard grade steel or extra-hard alloyed rails.

After rolling, the hot rail, which is then very sensitive to deformation, is exposed to a series of handling operations and operations such as transport on roller conveyors, cutting and transfers, which can create deformations. Their cooling is also a source of substantial deformations, despite all the precautions that can be taken to minimise or avoid them. Irregular cooling of the different parts of the rail the profile of which is asymmetric with respect to its two main planes has the effect that the rail coming from the cooling beds exhibits a more or less marked camber, which depends on the cooling conditions. The lengths of the fibres of the head, the web and the foot of the rail are unequal. Whatever precautions are taken to avoid or minimise the camber resulting from cooling, it is impossible, in industrial production, to obtain, on leaving the cooling beds, 100% of rails sufficiently straight to be delivered in that state to the customers. The inevitably irregular cooling of the rail because of the asymmetrical profile of the rail is, on the other hand, a source of residual stress which can promote the propagation of cracks when the rail is installed in the track, principally with extra-hard rails used on heavily loaded tracks (for example, mine tracks or heavy haul tracks).

The heat treatment of rails, applied to all or a part of their profile, before their passage through the cooling beds, or the controlled cooling of rails in pits, increase the risks of substantial deformations and residual stresses. The less severe specifications applicable to the production of rails no longer allow them to be used in the straightness condition that they present when they leave the cooling beds. It is absolutely necessary to straighten them. In all straightening methods, it is necessary to subject the metal to a stress greater than the elastic limit, so as to treat it in the plastic deformation region, at least locally.

Two types of straightening machines have been and are still being used according to the prior art. The older is a gag press in which a portion of rail that is to be straightened is laid upon two supporting anvils. A press piston, which moves vertically, on the free end of which is fixed a liner piece adaptable to the dimension of the rail to be straightened, deforms by pressure the portion of the rail, to give it an inverse bending. Laterally located anvils and pistons, allow, by the same principle, the lateral straightening of rails. The press operator detects visually the parts of the rail that need straightening and checks with a ruler, after each stroke of the press, the straightness obtained. This method of straightening, which requires an experienced operator, proceeding by multiple press strokes on portions of the rail, is rough and expensive. The result obtained does not meet all the requirements of a modern rail system.

In general, it is used today only as a complement to the straightening with roller straighteners that belong to the second type of straightening machinery. This machine straightens the rail in one or two inertial planes of the latter and comprises generally between 5 and 9 rollers. The rail is subjected alternately to bending deformations in opposite directions. The driven upper rollers draw the rail along and cause it to undergo, with the lower rollers, which are not driven, deformations in alternating opposite direction. In the triangle formed by the three first rollers, the rail is subjected to an a priori set deformation, which is not related to the actual deformation of each individual rail. In the second triangle formed by the second, third and fourth rollers, the rail is subjected to a deformation inverse to the first. The fifth roller and those following have the function, by appropriate alternating deformations, of making the rail straight. The ends of the rail are not straightened over a certain distance which corresponds to the axial spacing of the rollers. These ends must then be straightened by a gag press. The roller straightening method using rollers puts certain fibers of metal successively in tension and in compression. After a roller straightening, the web of the rail is in lengthwise elastic compression, while the head and the foot are in lengthwise elastic traction. These internal tensions due to the roller straightening. Regardless of the initial state of straightness of rails after the cooling stage, all rails are subjected in roller straightening to substantial deformation, leading to the following disadvantages.

sensible shortening of the rail;

reduction in the height of the rail profile;

increase of the width of the head and of the foot of the rail;

systematic differences in rail dimensions between the ends of the rails not worked by the rollers and the body of the rail which has been so worked;

frequent necessity to finish the straightening of the ends on a gag press which makes slight flats on the ends, and therefore renders impossible a perfect continuity of straightness with the main part of the rail;

systematic generation, in all rails, of stresses which can promote the propagation of cracks;

risk of forming brittle fracture zones in the interfaces of the web with the foot or the head. These fracture zones, being internal, are invisible and pose a very serious risk of a potential accident;

risk of creating on the head of the rail of sinusoidal waviness of various amplitudes due to hard-to-avoid eccentricities of the rollers, waviness which can cause more or less serious disturbance on the track when the train speed is important.

The roller straightening methods eventually used with gag presses permit the present specifications applicable to the manufacture of rails to be satisfied only at the cost of close and expensive control. The UIC 860 specification, for example, prescribes in regard to straightness, a maximum permissible deflection of 0.7 mm over 1.5 m for the end of the rails, the straightness being judged by the eye for the body of the bar. For rails intended for high speed train tracks on which trains travel at a regular speed of 260 Km/h (tracks on which a speed of 380 Km/h has been achieved) the UIC 860 specification is augmented by the following supplementary specifications:

the maximum permissible deflection is of 40 mm for 18 meter long rails and of 160 mm for 36 meter long rails;

the vertical amplitude of the waviness on the tread of the head shall be less than 0.3 mm;

the horizontal amplitude of the transverse waviness of the head of the rail shall be less than 0.5 mm;

alignment of the ends with the body of the bar, in the vertical direction, defined by a maximum permissible deflection of 0.3 mm measured with a 3 meter long ruler resting on the tread surface at the ends.

The meeting of these supplementary standards, which requires the roller straighteners and the gag press to be operated up to the limit of their possibilities, increases the cost of the straightening operation.

It has also been proposed to stretch straighten any metal profiles (see French Pat. No. 573/675 of Feb. 23, 1923). According to this process, any profile, more or less deformed, is straightened by stretching in order to regularly extend its fibers until the elastic limit of the metal is reached or even exceeded. It is known also that stretching a metal increases its hardness while reducing by substantial deformation its characteristics of ductility and resilience. Now, it is principally the tenacity which is important for a rail. This is probably essentially the main reason that up to now has prevented those skilled in the art from using the stretching method for straightening rails.

For economic reasons, rails are being made more and more of hard steel which is rather brittle due to its content of hardening elements, such as carbon for instance. It has been determined that in this kind of rail, the speed of propagation of fatigue cracks is very high. It is known that fatique can develop whenever the residual stresses reach a high level. It can be seen from the following table that for roller straightened rails, the internal stresses or tensions reach the following levels:

| Type of steel | breaking load | internal stress |
|---|---|---|
| UIC Standard grade steel | 700 to 900 N/mm$^2$ | 100 N/mm$^2$ |
| UIC Naturally hard steel | 900 to 1000 N/mm$^2$ | 200 N/mm$^2$ |
| UIC Extra-hard steel | 1100 to 1200 N/mm$^2$ | 300 N/mm$^2$ |

The invention which proposes to eliminate the disadvantages of the prior art methods of straightening rails and avoid the need for a complementary straightening with a press, has as its object:

the production of rails free from bends;

the guaranteeing of a continuity in the straightness between the ends and the body of the rail, by the elimination of all flats at the ends;

guaranteeing the absence of periodic waviness on the tread surface of the head;

elimination of the risk of brittle fracture in the regions that connect the web with the foot and the head;

not to create untoward internal tensions at the time of the straightening operation;

the reduction of internal tensions introduced into the rail by the operations preceding the straightening (heat, cooling treatments).

To achieve these objects, the invention proposes:

to submit the steel rail as shown per se to a tensile stress exceeding the conventional 0.2% offset yield strength of the steel up to a stress value corresponding to a complete plastic deformation of the entire rail.

By virtue of this fully plastic deformation of the rail by stretching, no residual stress is created by the operation of stretch straightening and the pre-existing residual strains are relieved.

For the known qualities and grades of steel, whether heat treated or not, it was discovered that the values of lengthwise residual stresses are lower than +/−100 N/mm$^2$ for grades of rail steel having a tensile strength Rm>1000 N/mm$^2$ and lower than +/−50 N/mm$^2$ for grades of rail steel having a tensile strength Rm≦1000 N/mm$^2$ as soon as the plastic deformation by stretching of the rail corresponds to a residual elongation of the order of 0.27%.

Put another way, a residual elongation of the rail of 0.3% after release of the stretching load guarantees the results stated above. The reduction of the residual internal stress of the rail to a low value improves the tenacity and the fatigue resistance of the rail. In effect, when the rail is positioned in the track, it is subjected inter alia to the stresses due to the long welded lengths of rails and to those due to traffic.

So long as the combination of these stresses does not exceed the endurance limit of any possible incipient cracks pre-existing in the rail, it will not lead to its fracture, whence it is of interest to have rails with residual internal stresses as weak as possible.

It has been discovered that the residual stresses cannot be reduced noticeably further once the whole of the material constituting the rail has undergone a total plastification. Accordingly, it is not necessary to submit the rail to a stretching load giving a value of residual elongation greater than 1.5%.

The invention aims also to provide straightened rails characterized by a value of residual internal stress lower than +/−100 N/mm$^2$ for grades of rail steel having a tensile strength Rm>1000 N/mm$^2$ and lower than +/−50 N/mm$^2$ for grades of rail steel having a tensile strength Rm≦1000 N/mm$^2$.

The characteristics and advantages of the invention will be evident from the following description of preferred embodiments. The description refers to the annexed drawings of which:

FIG. 1 shows a section of a rail with an indication of its constituent parts, of its neutral plan XX' and of its vertical plane of symmetry YY';

FIG. 2*a* is a perspective view of a rail as it leaves the cooling beds;

FIG. 2*b* is a side view of the same rail;

Figure 5:
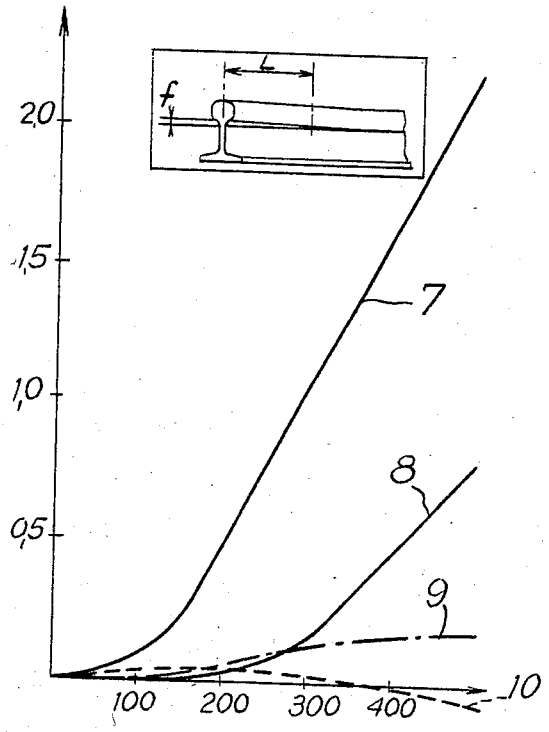
Figure 6A:
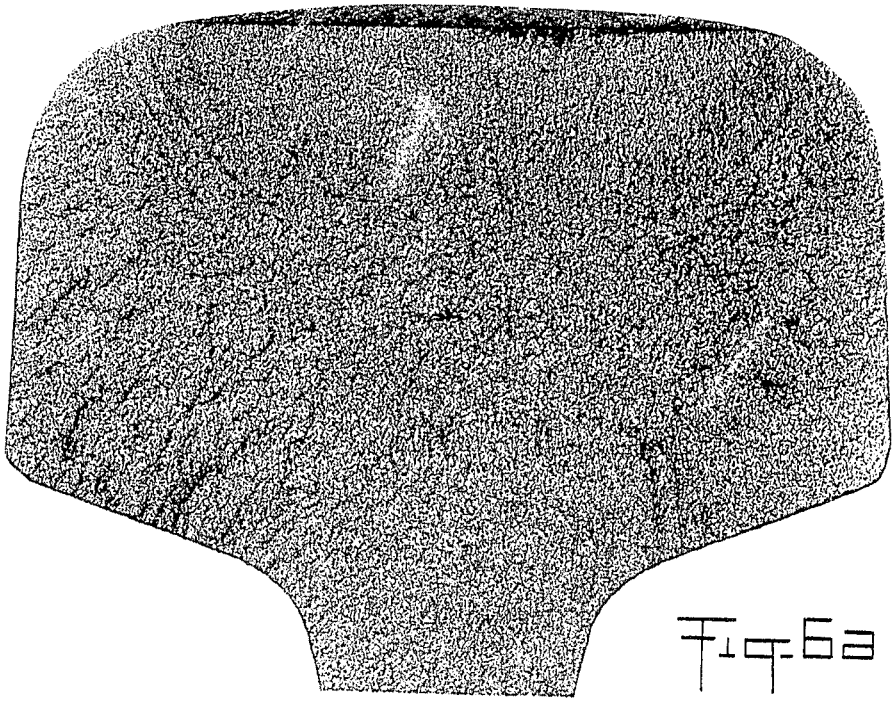
Figure 6B:
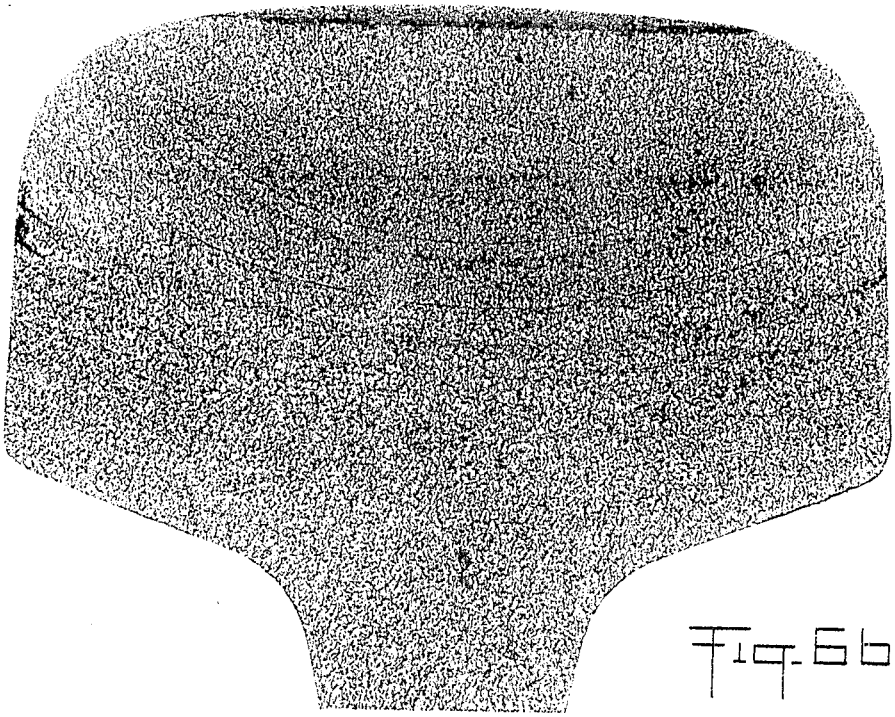
Figure 7:
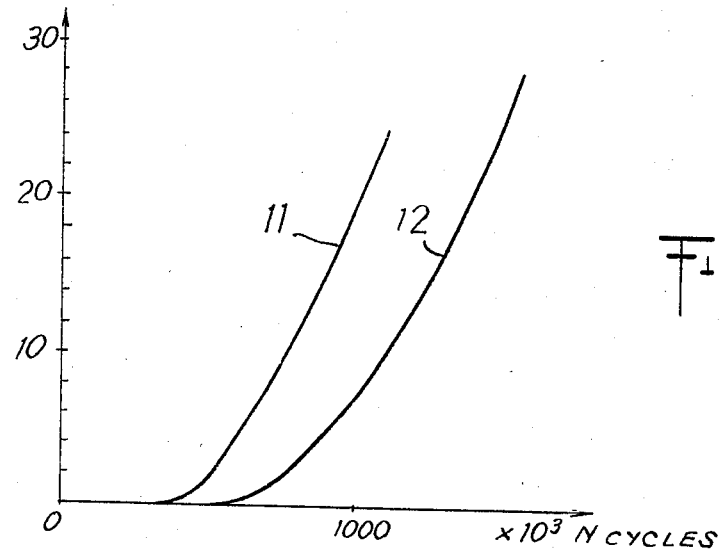

FIG. 5 shows in its upper inset part a section of rail with a saw cut of length L used for a test to establish the presence or otherwise of internal stresses, and, in its main part, a diagram showing the result of the empirical comparison of the state of residual stress by sawing the web and measuring the deviation of the head at the ends of rails which are unstraightened, roller straightened and straightened according to the invention;

FIGS. 6*a* and 6*b* each show the plane of fracture of a naturally hard rail B of UIC roller straightened according to the prior art (FIG. 6*a*) and a rail of the same grade straightened according to the invention (FIG. 6*b*), FIG. 6*b* showing that the fatigue crack before fracture in the rail straightened by stretching is longer than that of the roller straightened rail which presents a clearly more accentuated brittle character;

FIG. 7 shows the curves 11 and 12 of cracking compared with the propagation of the crack in a test of alternating flexure carried out in extra-hard grade alloy rails (UIC naturally hard, Rm<1100 N/mm$^2$. It is seen here that the fatigue resistance of the stretch straightened rail (curve 12) is superior to that of a roller straightened rail.

Figure 9:
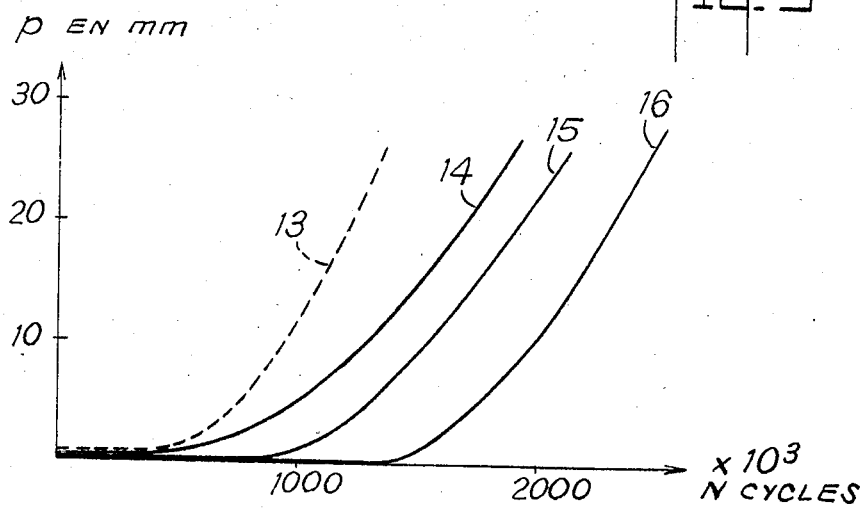

FIGS. 8*a*-8*b*-8*c*-8*d* show the fracture surfaces of four samples of a rail of extra-hard alloyed steel (Rm≧1080 N/mm²) respectively roller straightened, stretch straightened, not straightened (straight from the cooling bed) and first roller straightened, then stretch straightened. It is seen here that the stretching method of the invention eliminates any trace of brittleness in the cracks;

FIG. 9 shows the curves of cracking for the samples of rail of FIGS. 8*a*, 8*b*, 8*c* and 8*d*.

Figure 1:
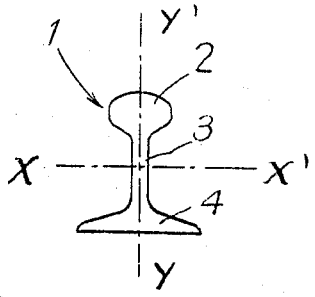
Figure 2:
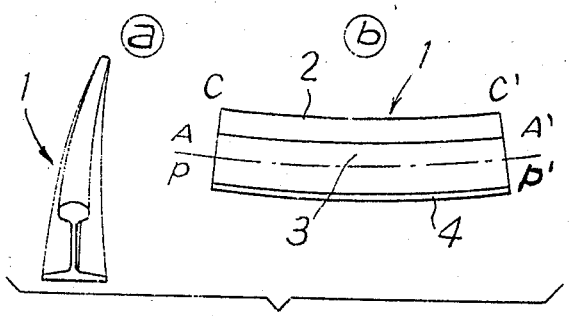
Figure 3:
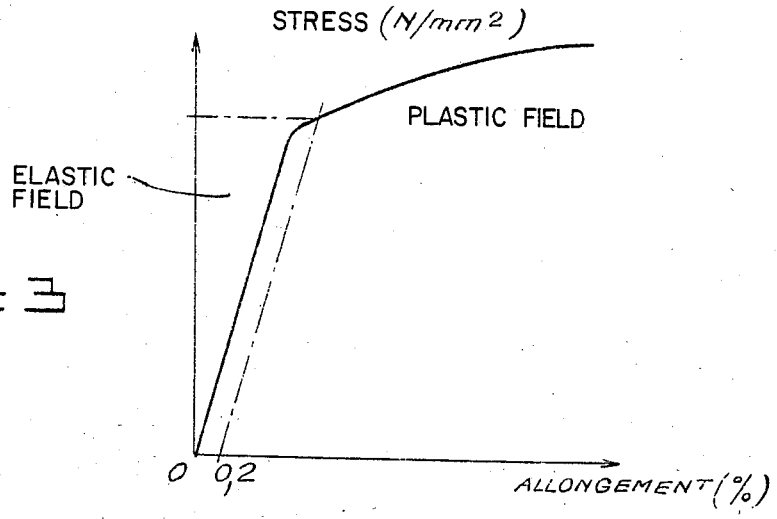
FIG. 3 is a stress-strain diagram of steel, showing the stress curve produced as a function of the elongation effected.
Figure 4:
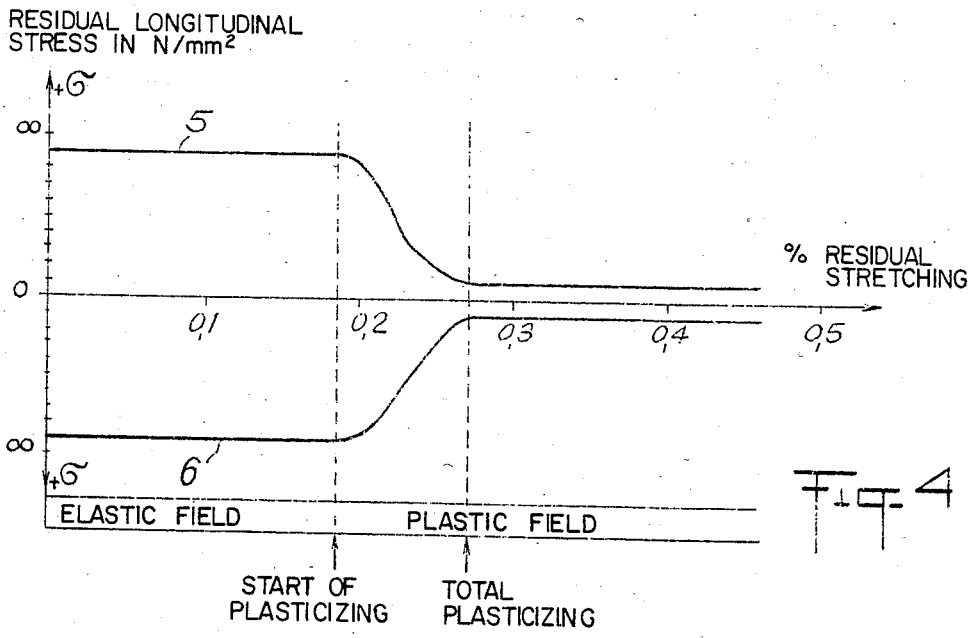
FIG. 4 shows, for a rail leaving the cooling beds, a diagram of the reduction of residual stress in the different constituent parts of the rail as a function of the level of residual elongation E.

A rail 1 leaving a cooling bed presents a warped curve (FIGS. 2*a* and *b*). The lengths of the fibers constituting the head 2, the web 3 and the foot 4 of the rail 1, being respectively the fibers CC', AA' and PP', are thus unequal. The principle of the invention is to submit the rail to a stretching load at each end which puts all the fibers under the effect of a stress sigma ($\sigma$) which exceeds the conventional 0.2% offset yield strength indicated by Rp 0.2 (FIG. 3), so as to take up the same length in the fully plastic domain of the rail steel under consideration. The amount of elongation necessary for this operation should be greater for the least stretched fiber than the amount of elongation corresponding to the initial drop in the load/elongation curve marking the beginning of the plastic domain of the steel. There is thus applied to the rail to be straightened a tensile load exceeding the yield strength so as to obtain, after releasing the load, a permanent elongation of at least 0.27%. This small residual elongation permits the production of straight rails, with less damage to the material than when it is roller straightened. The camber in the rail not being always regular along the length of some bars, one can encounter local radii of curvature smaller than the global radius of curvature. A residual elongation of the order of some tenths of a percent allows the removal of the shorter bends and, a fortiori, the longer bends. The existence of tensions or internal stresses coming from cooling implies inequalities in the lengths of the fibers of the rail. The straightening by plastic elongation of all the fibers and by preferential plastic elongation of the shorter fibers leads to a relaxation of residual internal stresses in the steel. FIG. 4 shows an example of the evolution of residual longitudinal stresses as a function of the amount of residual elongation for a rail of standard grade. The graph of FIG. 4 shows as the abscissa the residual elongation $\epsilon$ and as the ordinate the residual longitudinal stress $\sigma$ (−for compression, +for tension) in N/mm². The curve 5 represents the residual stress in the foot and the curve 6 that in the head of the rail. It is shown that the residual stress remains constant and high as long as the tensile load applied to the rail is in the elastic domain of the steel (value of $\epsilon \sim 0.185\%$) and that said residual stresses diminishes regularly beyond the elastic domain to reach constant minimum values from a residual elongation of the order of 0.27%.

It is readily understood that the domain of residual elongation comprised between the conventional yield strength ($\epsilon = 0.2\%$) and the minimum values of residual stress (here $\sigma \sim 10$N/mm² for $\epsilon \approx 0.27\%$) is a region of uncertainty and is therefore to be avoided and that as soon as the minimum value of residual stress is reached (as soon as $\epsilon \approx 0.27\%$ or 0.3%) an increase in residual elongation does not produce any further appreciable improvement in this respect, except for the increase of the yield strength by the effect of strain-hardening, said elevation of the yield strength can be carried out as desired: for example, for a UIC A naturally hard grade of steel or for a AREA grade, the elevation of the yield strength is of the order of 100N/mm² per 1% of supplementary residual elongation.

In other words, a residual elongation of 0.3% is sufficient in this case to remove the residual stresses, or to reduce them by a factor of the order of 10 to 1. The values measured with the so-called method of cutting confirmed by the so-called trepan drilling method, of the residual stresses of the rails designated by references 0.73 D 09, 236 D 23 and 150 C 13 stretch straightened with the method of the invention, and those of the roller straightened rails designated by the references 073 B 10, 236 D 23 and 150 C 13, all said rails having been produced close together, from the same heat and cooled close together on the cooling beds, are given below in tables I to III.

TABLE 1

| | Roller straightened Rail 073 B10 | | | Stretch straightened at 0.7% of residual elongation Rail 073 DO9 | | |
|---|---|---|---|---|---|---|
| | $\sigma$ max in compression N/mm² | $\sigma$ max in traction N/mm² | Total extent | $\sigma$ max in compression N/mm² | $\sigma$ max in traction N/mm² | Total extent of stresses |
| Principal stress $\sigma_1$ in the lengthwise direction | −260 | +230 | 490 | | +40 | 40 |
| Principal stress $\sigma_2$ in the vertical direction | −200 | +50 | 250 | −10 | +30 | 40 |

TABLE II

| | Roller straightening Rail 236 D 23 | | | Stretch straightening at 3% of residual elongation Rail 236 D 23 | | | Stretch straightening at 0.5% of residual elongation Rail 236 D 23 | | |
|---|---|---|---|---|---|---|---|---|---|
| | $\sigma$ max in compression N/mm² | $\sigma$ max in traction N/mm² | Total extent | $\sigma$ max in compression N/mm² | $\sigma$ max in traction N/mm² | Total extent | $\sigma$ max in compression N/mm² | $\sigma$ max in traction N/mm² | Total extent of stress |
| Principal stress $\sigma_1$ in the | −140 | +240 | 380 | −20 | +45 | 65 | −10 | +30 | 40 |

TABLE II-continued

| | Roller straightening Rail 236 D 23 | | | Stretch straightening at 3% of residual elongation Rail 236 D 23 | | | Stretch straightening at 0.5% of residual elongation Rail 236 D 23 | | |
|---|---|---|---|---|---|---|---|---|---|
| | σ max in compression N/mm² | σ max in traction N/mm² | Total extent | σ max in compression N/mm² | σ max in traction N/mm² | Total extent | σ max in compression N/mm² | σ max in traction N/mm² | Total extent of stress |
| lengthwise direction Principal stress $\sigma_2$ in the vertical direction | −150 | +30 | 180 | −40 | +10 | 50 | −10 | +20 | 30 |

TABLE III

| | Roller straightening Rail 150 C13 | | | Stretch straightening at 1% of residual elongation Rail 150 C13 | | |
|---|---|---|---|---|---|---|
| | σ max in compression N/mm² | σ max in traction N/mm² | Total extent | σ max in compression N/mm² | σ max in traction N/mm² | Total extent of stress |
| Principal stress $\sigma_1$ in the lengthwise direction | −143 | +282 | 425 | −21 | +10 | 31 |
| Principal stress $\sigma_2$ in the vertical direction | −89 | +26 | 115 | −27 | +8 | 35 |

Summing up, it appears that for a residual elongation of 0.3 to 1%, the level of residual stresses is at least 5 to 10 times less with the stretch straightening method than with the roller straightening method and that the scattering of the values of residual stress measured for stretch straightened rails is five times less than that measured for roller straightening rails. These experimental results were verified by stress measurements made with different methods in different laboratories (SACILOR, IRSID).

The relaxation of the residual internal stresses is such that the laboratories saw no significant differences between the level of stress of stretch straightened rails and the level of stress of the materials that were stress relieved to serve as references in the calibration of strain gauges. For example, in roller straightened rails one finds rather strong compression stresses, in the lengthwise direction as well as in the vertical direction, in the web and in the portions that connect it to the head and foot, these stresses being balanced, particularly in the lengthwise direction, by strong tensile stresses in the head and the foot. With stretch straightened rails, the residual stresses are very markedly weaker and much more uniform. It should be pointed out that the values of stress measured by the cutting method (method so-called of YASOJIMA and MACHII (1965) used, inter alia, by the OFFICE of RESEARCH and TESTING of the UIC in its study C53 "Residual stresses in rails") are confirmed in a satisfactory way by the so-called trepan drilling method. An empirical verification of the relaxation of internal stresses due to the stretch straightening has been made by means of a test which consists of separating the head from the rest of the profile and measuring its deviation f at its end in proportion to the advance L of the saw cut (method shown inset in the upper part of FIG. 5). The results of this test performed on a UIC 60 NDB rail are shown in the graph in FIG. 5, of which the abcissa indicates the length L in mm. of the saw cut and the ordinate shows the separation of deviation f in mm. of the sawn off head from the rest of the stump of the rail at the end thereof.

The curve 7 shows that a roller straightened UIC 60 NDB rail presents a separation f of the head of 2 mm for a saw cut of length L of 500 mm and the curve 8 shows for a same not straightened rail a separation which varies betwen 0 and 8/10ths of a mm. The curves 9 and 10 show that stretch straightened rails at 0.3 and 1% of residual elongation present a separation f respectively of 2/10ths and −1/10th of a mm (slight closing together) for a saw cut length L of 500 mm. There is shown to be an improvement in the value of f of the order of 1 to 10 in favour of the stretch straightening method of the invention. A minimal residual elongation of the order of 0.3% seems to be necessary to achieve a maximum relaxation of the internal stresses and it does not seem that an elongation greater than 1.5% offers any supplementary advantages.

The fact of stretching a rail beyond its conventional yield strength $RP_{0.2}$ might have given rise to a fear of damaging material in such a way that the damages would accelerate the propagation of eventually existing transverse fatigue cracks. A fatigue test by flexion at 4 points has shown that it is not so. The test consists in submitting a rail sample pre-notched in the head to an alternate flexion over a base length of 1.400 m at a frequency of 10 Hertz under a load of the order of 14 tonnes during a period for opening a crack and of 9 tonnes during the period of crack propagation, the load being applied to the head at two positions spaced by 150 mm situated symmetrically on each side of the central transverse notch.

The propagation of the fatigue crack from the notch is observed by means of a strain gauge and a so-called electrical method based on the variation of resistance of the rail during the course of the progression of the crack. One gets, by varying the amplitude of the applied stress, a series of readings at a given cumulative number of cycles and traces the curve of the depth of crack p against the number N of cycles effected.

This test has been applied in a first example, to two samples of a UIC 60 rail of naturally hard grade B, taken from the same bar, one sample having been roller straightened, the other stretch straightened. FIG. 6*a* shows that the roller straightened rail has a rather narrow fatigue crack area scattered with brittle pops; FIG. 6*b* shows the face of a stretch straightened rail which shows a clearly more developed area of fatigue crack, said area being free of brittle pops. Table IV below shows that the number of cycles required to initiate the crack and that the number of cycles required for its propagation are, under the same test conditions, clearly greater in the case of a stretch straightened rail, which is an indication of better tenacity and thus increased reliability.

TABLE IV

| | Roller Straightening | Stretch Straightening | Difference in % |
|---|---|---|---|
| Number of cycles for initiation | 350,000 | 500,000 | 142 |
| Number of cycles for propagation before a clean break | 750,000 | 1,050,000 | 140 |
| Critical depth of crack in mm | 25 | 28 | 112 |

Graphs 11 and 12 of FIG. 7 show the same relation p=f(n) mentioned in Table IV. Note that the ratio: fatigue surface (stretch straightening) fatigue surface (roller straightening) is equal to 1.55.

The previously mentioned test has been carried out, in a second example, on 4 samples of a 136RE rail in a grade of steel alloyed with crome-silicon-vanadium, having a tensile strength of 1080N/mm$^2$, taken from the same as rolled bar; it has been possible to compare the fatigue behaviour in the following different states.

roller straightened stretch straightened not straightened (as delivered by the cooling beds)

first roller straightened and then stretch straightened.

Figure 8A:
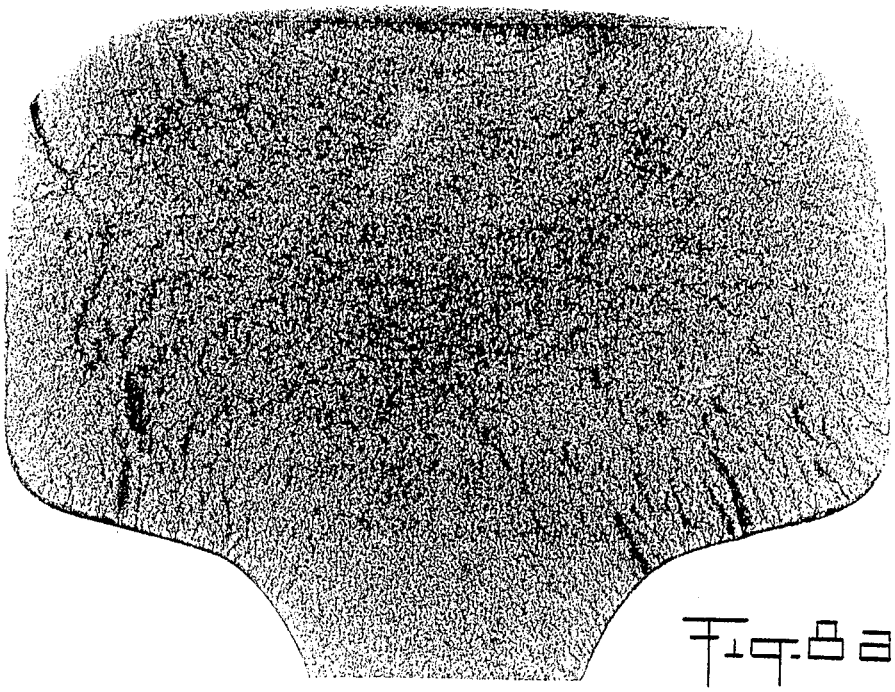
Figure 8B:
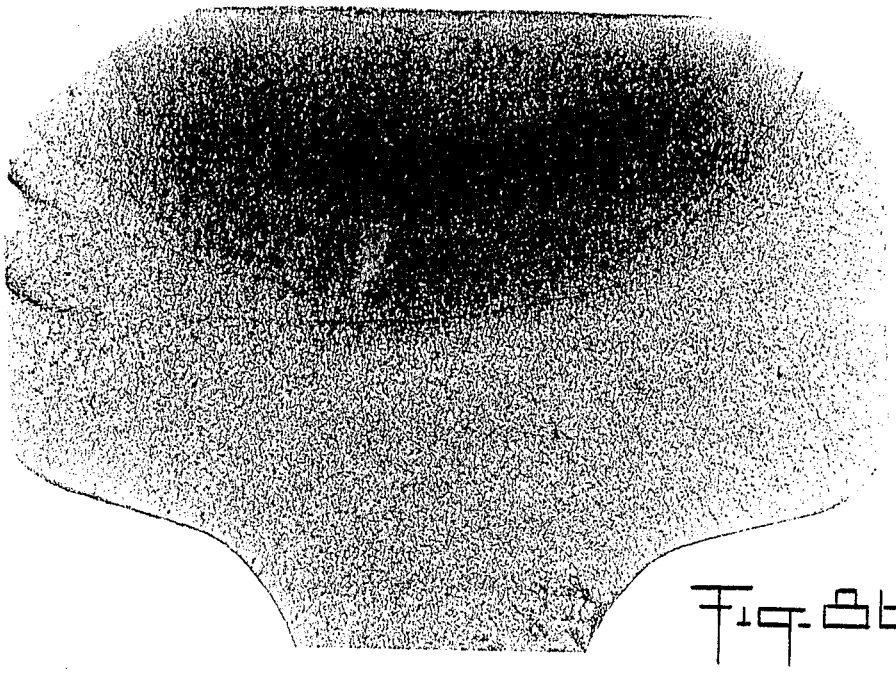
Figure 8C:
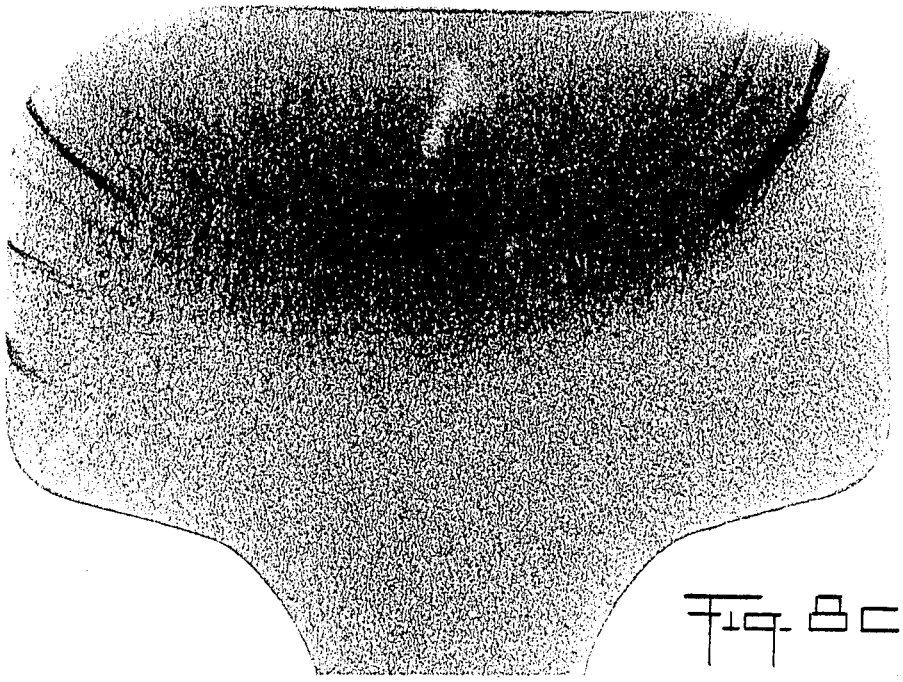
Figure 8D:
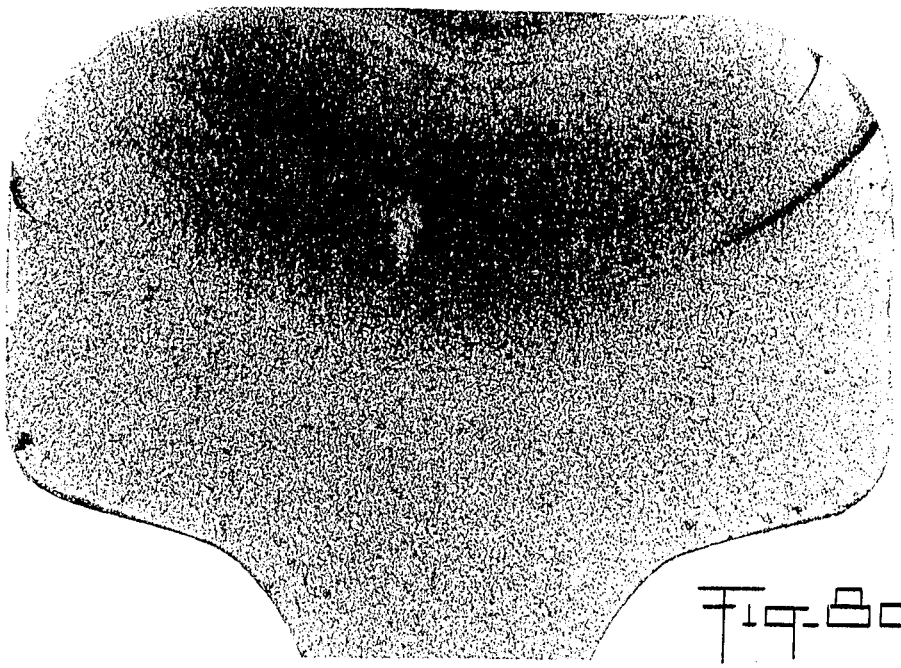

FIG. 8*a* shows the semi-brittle appearance of the broken surface of the roller straightened rail where no fatigue surface can be seen; FIG. 8*b* shows the large fatigue surface of the stretch straightened rail. FIG. 8*c* shows a fatigue surface of a not straightened rail, which is very slightly smaller than the latter; FIG. 8*d* shows that a stretch straightening applied after a preliminary roller straightening restores a good fatigue appearance.

Table V below shows the very clear improvement brought about by the stretch straightening to the number of cycles for initiation, and the number of cycles for propagation in comparison with the roller straightening.

TABLE V

| | Roller Straightening | Not Straightened | Stretch Straightened | Roller Straightened then Stretch Straightened |
|---|---|---|---|---|
| Number of cycles for initiation | 400,000 | 420,000 | 850,000 | 1,150,000 |
| Number of cycles for propagation up to a clean break | 950,000 | 1,500,000 | 1,250,000 | 1,400,000 |
| Critical depth of crack in mm. | 26 (semi-brittle) | 27 | 26 | 28 |

Curves 13 to 16 in FIG. 9 show the same relation p=f(n) as was mentioned in the foregoing Table V respectively for rails of a 136 RE steel and roller straightened (curve 13), not straightened (curve 14), stretch straightened (curve 15) and first roller straightened then by stretch straightened (curve 16). It follows very clearly from Table V and curves 13 to 16 of FIG. 9 that the resistance of a rail to the propagation of cracks is improved further still when a roller straightened rail is subjected to a stretching with residual elongation according to the invention in order to relieve the internal stresses.

The improvement in the behaviour of the rate of cracking of rails stretch straightened according to the invention is to be linked to the reduction of the residual stresses and in particular with the almost complete disappearance of residual traction stresses in the head of the rail, which are created by the roller straightening. This reduction of residual stress brought about by the method of straightening according to the invention enables the requirements of numerous railway track systems to be met, in particular of the heavy haul (such as mine tracks) which consider that residual stresses are responsible for the incidence of dangerous breaks in the track. The stretch straightening method of the invention considerably improves the fatigue behaviour of rails compared to that of the roller straightened rails.

Stretch straightening gives, inter alia, the advantage of raising the yield point of the metal, in contrast to the roller straightening method which has the tendency to lower it; this advantage is particularly interesting for the head, since a higher yield strength allows it better to resist plastic flow which could result from heavily laden wheels on the tread surface of the rail head. This raising of the yield point for UIC 90 grades A and B of steel, AREA, and similar, is of the order of 100N/mm$^2$ for 1% elongation. This property is observed in all steels, including the extra-hard alloyed or heat treated steels. The difference in the yield point between the roller straightened and the stretch straightened rails can amount to 20%.

It has been determined that this increase of the yield point is produced without degradation of the criteria of plasticity (distributed elongation and striction) or of the tenacity ($K_{1c}$, coefficient of critical intensity of stress).

The measurement of residual elongation on a certain number of base lengths marked along a rail has shown that the partial residual elongations measured on each of the base lengths are constant and are all equal to the global residual elongation given to the rail. No effect of localised striction on the length of the rails was noticed. The reduction in height is uniform over all the length of the rails, likewise the reduction in width of the foot. The slight variations in dimensions observed are, as in the case of roller straightening, priorily compensated for as before by an appropriate roll pass design, which allows the specified dimensional tolerances to be respected at least as easily as with the roller straightening method. In this latter method, dimensional irregularities nevertheless remain because the ends keep the original as rolled dimensions.

The invention also relates to railway rails having extremely small residual stresses. This type of rail is still not known at the moment, for in a quite recent study (April 1981, not published, made by R. Schweitzer and W. Heller (DUISBERG-RHEINHAUSEN) and entitled "Co-efficient of critical intensity of stress, inherent tensions and resistance to break of rails") it has been stated in conclusion that " . . . it is therefore important that the inherent stresses (=residual internal stresses) should be maintained at as low a level as possible if one wishes to increase the tensile strength." Now, at the present moment, this idea is scarcely realisable, the less so because the straightening of the rails, indispensible to achieve and set their straight form, results in substantial inherent tensions.

The present invention proposes rails which after straightening have low residual stresses which are:

lower than $+/-50N/mm^2$ ($+50N/mm^2$ in traction; $-50N/mm^2$ in compression) for rail steel grades (heat treated or not) of a tensile strength $Rm \leqq 1000N/mm^2$);

lower than $+/-100N/mm^2$ ($+100N/mm^2$ in traction; $-100N/mm^2$ in compression) for rail steel grades (heat treated or not) of a tensile strength $Rm > 1000N/mm^2$.

What is claimed is:

1. A method for straightening a railway rail and removing internal stresses therefrom comprising the steps of:

(a) providing a steel railway rail having an asymetrical profile and triaxial stress distribution pattern, and (b) simultaneously straightening the rail and removing internal stresses therefrom through stretching the rail by subjecting same to tensile stress exceeding the conventional 0.2% offset yield strength of the steel, and up to a stress value corresponding to a total plastic deformation of the whole rail.

2. The method of claim 1 wherein the rail is subjected to sufficient tensile stress to produce at least 0.3% residual elongation upon release of the stress.

3. The method of claim 1 wherein the rail is subjected to sufficient tensile stress to produce a maximum 1.5% residual elongation upon release of the stress.

4. The method of claim 1 wherein the rail is subjected to sufficient tensile stress to produce between 0.5 and 0.7% residual elongation upon release of the stress.

5. The method of claim 1 including providing a steel railway rail comprising a grade of rail steel having a tensile strength Rm lower than or equal to $1000N/mm^2$.

6. The method of claim 1 including providing a steel railway rail comprising a grade of rail steel having a tensile strength Rm greater than $1000N/mm^2$.

* * * * *